United States Patent [19]

Noguchi et al.

[11] 4,349,447

[45] Sep. 14, 1982

[54] PHOSPHATE-FREE DETERGENT COMPOSITION

[75] Inventors: Tatsuhiko Noguchi; Ryuichi Kurita; Ken Nemoto; Kiichi Endo, all of Iwaki, Japan

[73] Assignee: Kureha Kagaku Kogyo Kabushiki Kaisha, Tokyo, Japan

[21] Appl. No.: 212,527

[22] Filed: Dec. 2, 1980

[30] Foreign Application Priority Data

Dec. 5, 1979 [JP] Japan ..... 54-157789

[51] Int. Cl.[3] ..... C11D 1/10; C11D 9/10

[52] U.S. Cl. ..... 252/117; 252/545; 252/546; 252/549

[58] Field of Search ..... 252/117, 545, 546, 549

[56] References Cited

U.S. PATENT DOCUMENTS

| | | | |
|---|---|---|---|
| 2,880,178 | 3/1959 | Ruff et al. | 252/545 X |
| 3,707,505 | 12/1972 | Maeda et al. | 252/136 |
| 4,203,873 | 5/1980 | Suzuki et al. | 252/545 |
| 4,268,424 | 5/1981 | Hall et al. | 252/546 |
| 4,305,836 | 12/1981 | Noguchi et al. | 252/117 |

FOREIGN PATENT DOCUMENTS

| | | |
|---|---|---|
| 47-16504 | 9/1972 | Japan . |
| 48-33964 | 10/1973 | Japan . |
| 52-72709 | 6/1977 | Japan . |
| 53-46841 | 12/1978 | Japan . |
| 54-123108 | 9/1979 | Japan . |

OTHER PUBLICATIONS

Chemical Abstracts, vol. 87, 1977, p. 778, 202054c.

*Primary Examiner*—P. E. Willis, Jr.
*Attorney, Agent, or Firm*—Wegner & Bretschneider

[57] ABSTRACT

There is provided a novel detergent composition containing no phosphorus component, which comprises an anionic and/or nonionic synthetic surfactant(s) and an effective amount of a mixture in a specified proportion consisting essentially of an imido-bis-sulfate salt, a palmitate salt and an N,N-bis(carboxymethyl)glutamate salt and/or a salt of N,N-bis(carboxymethyl)phenylalanine. The detergent composition exhibits the detergency at least equivalent to conventional detergent compositions containing 20% or more of sodium tripolyphosphate and causes no pollution problems.

3 Claims, 5 Drawing Figures

| | | | | | | |
|---|---|---|---|---|---|---|
| LAS | 0.020 | 0.020 | 0.020 | 0.020 | 0.020 | 0.020 |
| POE-OE | 0.020 | 0.020 | 0.020 | 0.020 | 0.020 | 0.020 |
| TSIS | 0.160 | 0.128 | 0.096 | 0.064 | 0.032 | 0 |
| Glu | 0 | 0.032 | 0.064 | 0.096 | 0.128 | 0.160 |

Concentration (wt %)

| | | | | |
|---|---|---|---|---|
| LAS | 0.040 | 0.040 | 0.040 | 0.040 |
| TSIS | 0.080 | 0.076 | 0.070 | 0.060 |
| Phal | 0.080 | 0.076 | 0.070 | 0.060 |
| Pal | 0 | 0.008 | 0.020 | 0.040 |

Concentration (wt %)

PHOSPHATE-FREE DETERGENT COMPOSITION

BACKGROUND OF THE INVENTION

This invention relates to a novel detergent composition. More particularly, it relates to a synthetic detergent composition containing no phosphorus component which comprises an anionic and/or nonionic synthetic surface active agent(s) (hereinafter referred to as a surfactant) and a mixture consisting essentially of a salt(s) of imido-bis-sulfuric acid, a salt of palmitic acid and a salt of N,N-bis(carboxymethyl)glutamic acid and/or N,N-bis(carboxymethyl)phenylalanine and which is very excellent in detergency and biodegradability.

DESCRIPTION OF THE PRIOR ART

It is well known that a detergent containing as its active component a surface active agent is enhanced in its washing performance when incorporated with the other suitable components (the so-called builder).

There have been known in the art inorganic salt builders such as sodium tripolyphosphate and other various phosphate salts, sodium silicate, salt cake (sodium sulfate) and sodium carbonate, as well as organic builders such as organic chelating builders and high molecular electrolyte builders. The properties required for builders, include a chelating action; an ability to be adsorbed as anions onto the surfaces of solid and liquid dirt particles and to lower the zeta-potential thereof; an ability to lower the critical concentration of micelle formation (C.M.C.); a buffer action to alkalinity (the property where alkalinity of washing liquors is not changed in the presence of a small amount of acidic substances); and other properties such as cleaning performances in a broader sense, no environmental pollution and economical efficiency.

The above prior art builders, however, can not satisfy all of the above-mentioned requirements, and a very satisfactory builder in practical uses has not been available. Among these conventional builders, sodium tripolyphosphate has been most widely used because of its inherent ability as the builder such as detergency. The abundant use of sodium tripolyphosphate, however, is deemed as the sourse of eutrophication of waste water. Thus it has been desired to develop a superior builder which will satisfy the above-mentioned requirements and take the place of such conventional builders.

In this connection, Japanese Laid-Open Patent Publication No. 46303/76 descloses a builder consisting of an imido-bis-sulfate represented by the formula $(MSO_3)_2NM'$, which may exhibit the detergency compared to that of a certain phosphate or sodium metasilicate when formulated with a surfactant. It however seems unsatisfactory in other properties such as prevention of redeposition. Japanese Laid-Open Patent Publication No. 16010/78 discloses partial replacement of sodium tripolyphosphate with an imido-bis-sulfate. In this case, however, the amount of sodium tripolyphosphate can be reduced as far as 10% by weight, and further reduction of sodium tripolyphosphate markedly lowers detergency of the resulting detergent composition.

Upon washing clothes, the following two stages of detergent actions have been elucidated; (i) removal of dirts (surface-activity, ability of sequestering ions such as $Ca^{2+}$ and $Mg^{2+}$), and (ii) prevention of redeposition of dirts by means of adsorption of anions onto the surfaces of dirts due to the formation of electric double layers.

On the basis of knowledge that the effective detergent actions can be attained by those substances which are excellent in chelating ability for removing dirts and make zeta-potential of the surfaces of fibers and dirt particles negative for preventing redeposition of dirts, the present inventors have found that palmitate salts are very effective for lowering the zeta-potential and that the salts of N,N-bis(carboxymethyl)glutamic acid and N,N-bis(carboxymethyl)phenylalanine are excellent in chelating ability and biodegradability, and thus have accomplished the present invention. The unexpected effects obtained by the present detergent composition comprising an anionic and/or nonionic synthetic surfactant and a mixture consisting of an imido-bis-sulfate, a palmitate and a salt of N,N-bis(carboxymethyl)glutamic acid and/or a salt of N,N-bis(carboxymethyl)phenylalanine are clearly shown in the following descriptions and especially in Examples and Reference Example 3.

Thus, an object of the invention is to provide a novel detergent composition which is excellent in removal of dirts and prevention of redeposition and exhibits very excellent detergency.

Another object of the invention is to provide a novel detergent composition which has excellent detergency and contains no phosphorus compound.

The other object of the invention will be made clear by the following descriptions.

SUMMARY OF THE INVENTION

In accordance with the present invention is provided a detergent composition which comprises an anionic and/or nonionic synthetic surfactant(s) and an effective amount of a mixture consisting essentially of a salt of imido-bis-sulfuric acid (i.e. imido-bis-sulfate), a salt of palmitic acid (i.e. palmitate) and a salt(s) of the carboxylic acid(s) selected from N,N-bis(carboxymethyl)-glutamic acid, N,N-bis(carboxymethyl)phenylalanine and the mixtures thereof. The present detergent composition is characterized in that the surfactant is formulated with the imido-bis-sulfate having a proper chelating ability and a very high pH-burrering action, the palmitate having high ability for sequestering ions such as $Ca^{2+}$ and $Mg^{2+}$ and also high ability to lower the zeta-potential of the surfaces of dirts and fibers, and the salt(s) of N,N-bis(carboxymethyl)glutamic acid and/or N,N-bis(carboxymethyl)phenylalanine having high chelating ability and excellent biodegradability. The present detergent composition is superior in removal of dirts and prevention of redeposition, and exhibits very excellent detergency. The present composition is also characterized by the detergency equivalent or superior to the conventional detergent compositions containing as much as 20% or more of sodium tripolyphosphate, in spite of the absence of sodium tripolyphosphate.

DETAILED DESCRIPTION OF THE INVENTION

Figure 1:
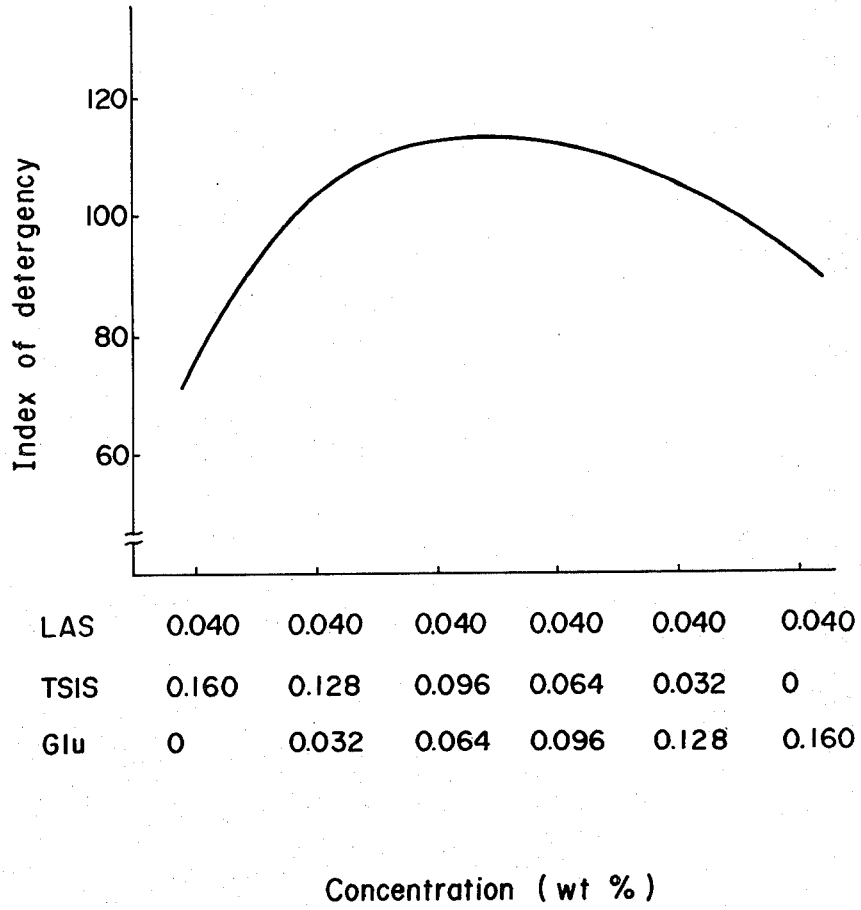
FIGS. 1 and 2 are the graphs for reference showing the relationship between the ratio of components and the index of detergency when a surfactant is formulated with trisodium imido-bis-sulfate and sodium N,N-bis(-carboxymethyl)glutamate.
Figure 2:
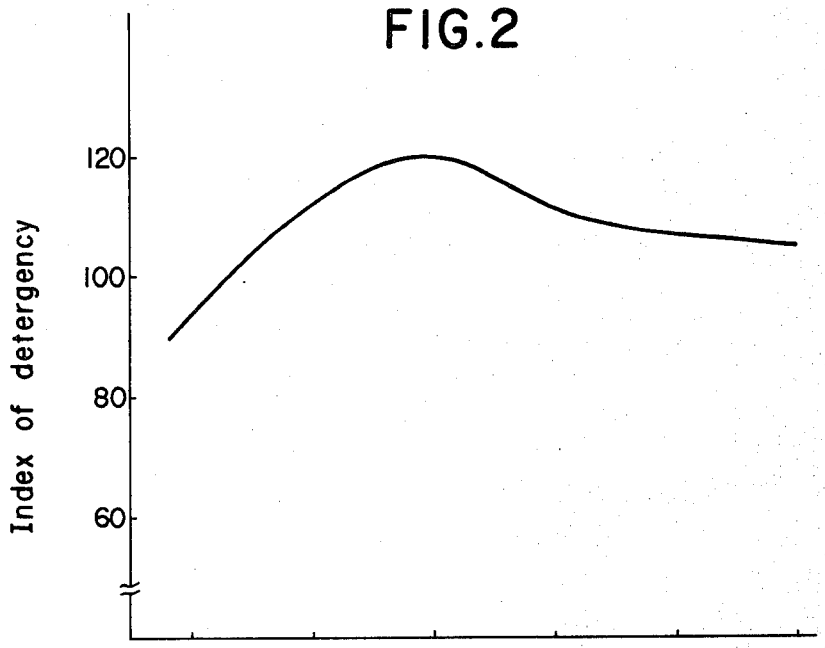

The imido-bis-sulfates (salt of imido-bis-sulfuric acid) used in the present detergent composition are the compounds represented by the general formula $(M^1SO_3)_2NM^2$, wherein $M^1$ stands for sodium, potassium, lithium or ammonium and $M^2$ stands for hydrogen, sodium, potassium, lithium or ammonium and the mixtures thereof; among these compounds, trisodium imido-bis-sulfate wherein both $M^1$ and $M^2$ are sodium (hereinafter referred to as TSIS) is preferred. The imido-bis-sulfate, when it is formulated with a surfactant together with an N,N-bis(carboxymethyl)glutamate and/or a salt of N,N-bis(carboxymethyl)-phenylalanine, enhances the cleaning performance due to a synergistic effect of the formulated components as shown in FIGS. 1 and 2.

The palmitate salts (salts of palmitic acid) used in the present invention are sodium or potassium salt of palmitic acid and mixtures thereof, and sodium palmitate is generally preferred. The zeta-potential value of sodium palmitate determined by means of a electrophoretic method is −52 mV, which is a larger negative value than those of other fatty acid salts; e.g., about −38 mV of sodium stearate, about −37 mV of sodium laurate, about −34 mV of sodium myristate.

Figure 3:
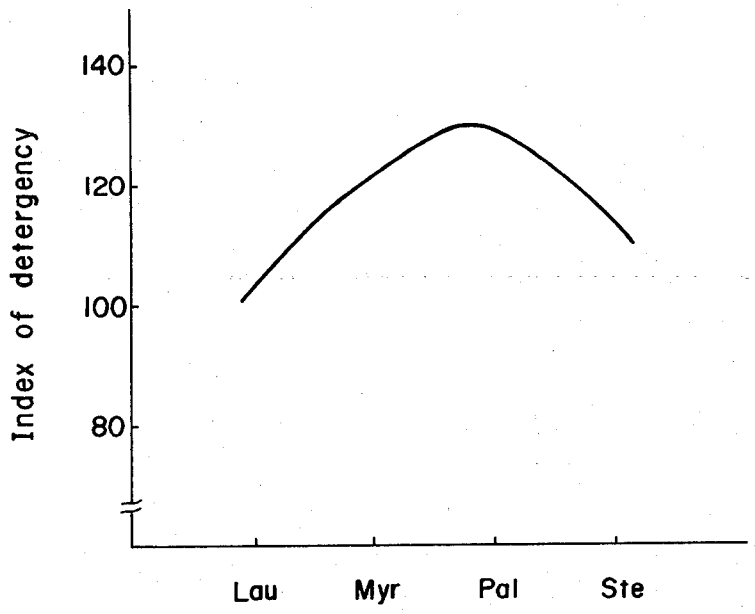
FIG. 3 is the graph for reference showing the relationship between the salts of fatty acids used and the index of detergency.

The palmitate salt having such a large zeta-potential value, when incorporated into a surfactant together with the imido-bis-sulfate and an N,N-bis(carboxymethyl)glutamate, further enhances the detergency of the resulting composition as shown in Reference Example 3 and FIG. 3.

The palmitate salt can also be used to enhance detergency in the form of its mixture with other fatty acid salts. By these fatty acid salts are meant sodium, potassium or ammonium salts of saturated or unsaturated fatty acids preferably having 12 to 18 carbon atoms. The saturated fatty acids include lauric acid, myristic acic, stearic acid, etc. and the unsaturated fatty acids include oleic acid, linolic acid, linolenic acid, ricinoleic acid, etc.

The salts of N,N-bis(carboxymethyl)glutamic acid used in the present invention are normally sodium or potassium salts of N,N-bis(carboxymethyl)glutamic acid such as the mono-, di-, tri- and tetra-sodium or potassium salts thereof, and the mixtures of these salts. Among them, the sodium salts are preferred.

The salts of N,N-bis(carboxymethyl)phenylalanine used herein are normally the sodium or potassium salts such as the mono-, di- and tri-sodium or potassium salts thereof, and the mixtures of these salts. Among them, sodium salts are preferred.

The ratios of these components to be formulated in the present compositions are generally in the following ranges. The palmitate salts are used in the range of about 3 to about 60 parts by weight and preferably 20 to 40 parts by weight per 100 parts by weight of the surfactant. When the amount of the palmitates is less than about 3 parts by weight, a satisfactory result can not be attained since the zeta-potential of fiber surfaces is not fully lowered and therefore, the redeposition of dirts is not satisfactorily prevented. When it is more than about 60 parts by weight, the palmitate is not dissolved completely and remains partly in a solid form.

In the case where the palmitate is used together with other fatty acid salts, the total amount of the palmitate and the other fatty acid salts is preferably not more than about 500 parts by weight per 100 parts of the surfactant.

The amount of the imido-bis-sulfates to be formulated is generally in the range of about 30 to 700 parts by weight per 100 parts of the surfactant. The amount of the salt(s) of N,N-bis(carboxymethyl)glutamic acid and/or N,N-bis(carboxymethyl)phenylalanine to be used is in the range of about 1 to 250 parts by weight per 100 parts of the surfactant.

More specifically, the total amount of imido-bis-sulfates, palmitates and the salt(s) of N,N-bis(carboxymethyl)glutamic acid and/or N,N-bis(carboxymethyl)-phenylalanine is in the range of about 40 to about 1000 parts and preferably about 90 to 700 parts by weight per 100 parts by weight of the surfactant. As to the ratio of imido-bis-sulfates to the salt(s) of N,N-bis(carboxymethyl)glutamic acid and/or N,N-bis(carboxymethyl)-phenylalanine, it is preferable that the imido-bis-sulfate is in the range of about 5 to 80% by weight and the glutamate and/or the phenylalanine is in the range of about 95 to 20% by weight per the total amount thereof.

Incidentally, the present detergent composition can be further incorporated with sodium silicate, sodium carbonate, carboxymethylcellulose (C.M.C.), sodium sulfate and the like which are contained in conventional detergent compositions in an amount conventionally used. If desired, the present composition may further contain a variety of adjuvants such as sodium percarbonate, sodium perborate, borax, sodium toluenesulfonate and sodium xylenesulfonate.

The anionic surfactants to be used in the present invention include, for example, sodium alkylsulfates, sodium linearalkylbenzenesulfonates, sodium α-olefin-sulfonates, sodium alkylpolyethersulfates, and the mixtures thereof. The nonionic surfactants for use in the present invention include, for example, polyoxyethylenealkylethers, polyoxyethylene-long-chain fatty acid esters, polyoxyethylene-polyoxypropylene block copolymers, and the mixtures thereof.

As described above, the detergent composition of the present invention comprises the imido-bis-sulfate salts having excellent pH-buffering action, the palmitate salts having high ability to reduce zeta-potential, and the N,N-bis(carboxymethyl)glutamate or the N,N-bis(carboxymethyl)phenylalanine salt having excellent chelating ability. Due to the synergistic effects of these components, the present detergent composition can exhibit the detergency equivalent or superior to that of the conventional detergent compositions containing as much as 20% by weight of sodium tripolyphosphate, without using a phosphorus component which is an eutrophication source of waste water. Moreover, the present composition is economical and practically useful because of little influence on environment, and also does not substantially roughen the skins of consumers.

The present invention is further explained in the following by way of Example and Reference Examples, wherein all the parts and percentages are based on weight unless otherwise specified. The standard detergent, stained cloth, washing test, and calculation of detergency index which are used in the examples are given below.

(1) Constitution of the standard detergent sodium linear-alkylbenzenesulfonate: 17 (% by weight)
sodium tripolyphosphate: 20
sodium metasilicate: 10
sodium carbonate: 3
carboxymethylcellulose: 1
moisture: 10
sodium sulfate: 39

(2) Artificially stained cloth (cotton)

Cotton cloth was immersed in a staining bath containing 8 parts of oil, 0.3 to 0.4 part of carbon black and 800 parts of tetrachloroethylene for 30 seconds, and then air-dried to prepare artificially stained cloth. The oil used in the bath consists essentially of 15 parts of oleic acid, 7.5 parts of palmitic acid, 7.5 parts of myristic acid, 15 parts of triolein, 15 parts of tripalmitin, 10 parts of cholesterol, 5 parts of squalene, 10 parts of liquid paraffin, 10 parts of setanol, and 5 parts of cholesterol palmitate.

(3) Washing test

Four (4) pieces of the artificially stained cloth (5×10 cm each in size) were placed in a wash-bottle 400 ml in capacity having 10 steel balls (6.5 mm in diameter) therein, and washed under the following conditions using a launda-o-meter.

Laundry Conditions

Concentration of a detergent: 0.20%
Washing liquor: 100 g
Ratio of cloth to water: 1/50
Water temperature: 30° C.
Period of time: 10 minutes
Water hardness: 50 ppm as $CaCO_3$ (adjusted with $CaCl_2$)
Rinsing with tap water at 30° C.: 5 minutes with 200 ml in total (4) Calculation of a detergency index The washing effeciencies (D) of the standard detergent and a candidate detergent are obtained according to the following formula. The index of detergency is expressed by the ratio of the efficiency of a candidate detergent to that of the standard detergent obtained under the same condition, multiplied by 100.

$$D=[(R-R_o)/(R'-R_o)]\times 100$$

wherein, R is reflectance of washed cloth which had been stained, R' is reflectance of the original cloth, and $R_o$ is reflectance of stained cloth before washing, the reflectance being determined through a green filter.

Method for determination of biodegradability of a substance by microbes (MITI method)

1. Principle

The amount of oxygen consumed by the substance when it is degraded by microbes in the standard activated sludge is determined under a set of predetermined conditions. The thus obtained amount of oxygen is compared to the theoretical amount of oxygen required to completely degrade the substance, and the ratio multiplied by 100 is called the "biodegradability" of the substance.

2. Apparatus

An apparatus called as an oxygen demand-determination apparatus in closed system (manufactured by Ohkura Electric Co., Ltd., Tokyo, Japan) is utilized.

3. Reagents and microbes (3-1) Reagnets

As a basic culture medium, a mixture of the following four solutions A, B, C and D is used after dilution:

Solution A (buffer solution) is prepared by dissolving 21.75 g of $K_2HPO_4$, 8.5 g of $KH_2PO_4$, 44.6 g of $Na_2HPO_4.12H_2O$, and 1.2 g of $NH_4Cl$ in water to make the total volume 1,000 ml. The resulting solution has a pH of 7.2.

Solution B is prepared by dissolving 22.5 g of $MgSO_4.7H_2O$ in water to make the total volume 1,000 ml.

Solution C is prepared by dissolving 27.1 g of anhydrous $CaCl_2$ in water to make the total volume 1,000 ml.

Solution D is prepared by dissolving 0.25 g of $FeCl_3.6H_2O$ in water to make the total volume 1,000 ml.

(3-2) Microbes

Standard activated sludge available from the Chemicals Safety Center, Association of Inspection of Chemical Commodities, Japan, is used under the indication of Japanese Industrial Standards (JIS) K0102, Sec. 10.2.3.

4. Procedures of test

The following 5 vials, (1), (2), (3), (3)' and (4) were respectively filled with a diluted solution prepared by diluting the mixture of each 3 ml of Solutions A, B, C and D with water to make the whole volume 1,000 ml (the diluted solution is called as the basic culture medium).

To Vial(1), the substance to be tested is added at a concentration of 100 ppm(weight/volume).

To Vial(2), the substance to be tested is added at a concentration of 30 ppm(weight/volume).

To two Vials(3) and (3)', which are used as controls, nothing is added in this stage.

To Vial(4), aniline is added at a concentration of 100 ppm(weight/volume).

Then, the Standard Activated Sludge was inoculated into the basic culture medium of the above-mentioned 5 vials, and cultured at a temperature of 25°±1° C. for a predetermined period of time (in principle, 4 weeks) under sufficient agitation by stirring. The above-mentioned culture is carried out so that the concentration of suspendable materials contained in the Standard Activated Sludge attains to 30 ppm(weight/volume) as is indicated by JIS K 0102, Sec. 10.2.3. During the culture, the amount of consumed oxygen in the vials are determined as the time pass by.

5. Derivation of the biodegradability

As stated in Para. 1, the biodegradability is derived from the amount of consumed oxygen according to the following formula:

$$\text{Biodegradability (\%)}=[(BOD-B)/TOD]\times 100$$

wherein BOD is the biological oxygen demand of the substance to be tested, that is, the amount of oxygen consumed actually by the substance (mg) determined in Vial(1) or (2), B is the amount of oxygen consumed by the basic culture medium (mg) in Vial(3) or (3)', and TOD is the theoretical amount of oxygen necessary for the complete degradation of the substance to be tested.

6. Confirmation

In the case where in Vial(4), the biodegradability of aniline after 7 day-culture does not exceed 40%, all the tests carried out in Paragraph 5 are deemed to be invalid.

Test Results

1. Biodegradability of trisodium salt of N,N-bis(carboxymethyl)phenylalanine

Following the method for determination of biodegradability of a substance, trisodium salt of N,N-bis(carboxymethyl)phenylalanine was introduced into 300 ml of the basic culture medium contained in Vial(1) to be a concentration of 100 ppm(weight/volume). Then, the pH of the resulting medium is adjusted to a range of 7 to 7.4. After inoculating the Standard Activated Sludge into the above-mentioned medium in such an amount as to make the concentration of the suspendable materials contained in the Standard Activated Sludge 30 ppm(volume/volume), the vial was cultured at 25°±1° C. under sufficient stirring. After 2 weeks culture, the biodegradability of the tested substance reached as high as about 90%.

As is mentioned above, the compound tested is highly biodegradable.

2. Biodegradability of tetrasodium salt of N,N-bis(carboxymethyl)glutamic acid

In the same manner as above, the biodegradability of tetrasodium salt of N,N-bis(carboxymethyl)glutamic acid was tested. In this case, however, the concentration of the suspendable materials contained in the Standard Activated Sludge was adjusted to 100 ppm(volume/volume). The biodegradability of the tested substance reached as high as about 75% after 2 weeks.

As is mentioned above, the biodegradability of this compound is much superior to that of EDTA.

REFERENCE EXAMPLE 1

Detergent composition were prepared which contained as a surfactant 20 parts of sodium linear-alkyl ($C_8$–$C_{18}$) benzenesulfonate (hereinafter referred to as LAS) and as a builder 80 parts of a mixture of trisodium imido-bis-sulfate (herein referred to as TSIS) and sodium salts of N,N-bis(carboxymethyl)glutamate (hereinafter, referred to as Glu) in various proportions. The performances of builders on the resulting compositions were determined by washing tests. The result are shown in FIG. 1.

As clearly shown in FIG. 1, the detergent compositions containing the surfactant and either TSIS or Glu alone do not enhance the washing performance of the compositions. The detergent compositions containing the surfactant and suitable amount of both TSIS and Glu can enhance the washing performance.

REFERENCE EXAMPLE 2

Detergent compositions were prepared which contained as surfactant 10 parts of LAS and 10 parts of polyoxyethylenemonooleyl ether (an adduct of 10 moles of ethylene oxide groups) (hereinafter referred to as POE-OE) and as a builder 80 parts of a mixture of TSIS and Glu in various proportions. The builder performances of the resulting compositions were determined according to the washing tests. The results are shown in FIG. 2.

REFERENCE EXAMPLE 3

Detergent compositions were prepared which contained as a surfactant 20 parts of LAS and 35 parts of TSIS, 35 parts of Glu and 10 parts of sodium salt of a fatty acid. The performances of the resulting compositions based on the types of sodium salts of fatty acids were determined according to the washing tests. The results are shown in FIG. 3. Incidentally, in FIG. 3, Lau=sodium laurate, Myr=sodium myristate, Pal=sodium palmitate, and Ste=sodium stearate. The concentrations of the components in the washing liquor were as follows. LAS: 0.040%, TSIS: 0.070%, Glu: 0.070% and sodium salt of a fatty acid: 0.020%.

EXAMPLE 1

Detergent compositions were prepared which contained as a surfactant 20 parts of LAS and 80 parts of a mixture consisting of a 1:1 ratio of TSIS and Glu and various amounts of sodium palmitate (hereinafter referred to as Pal). The performances of the resulting compositions were determined according to the washing tests. The results are shown in FIG. 4.

EXAMPLE 2

Detergent compositions were prepared which contained as a surfactant 20 parts of LAS and 80 parts of a mixture consisting of a 1:1 ratio of TSIS and sodium salts of N,N-bis(carboxymethyl)phenylalanine (hereinafter referred to as Phal) and various amounts of sodium palmitate. The performances of the resulting compositions were determined according to the washing tests. The results are shown in FIG. 5.

Figure 4:
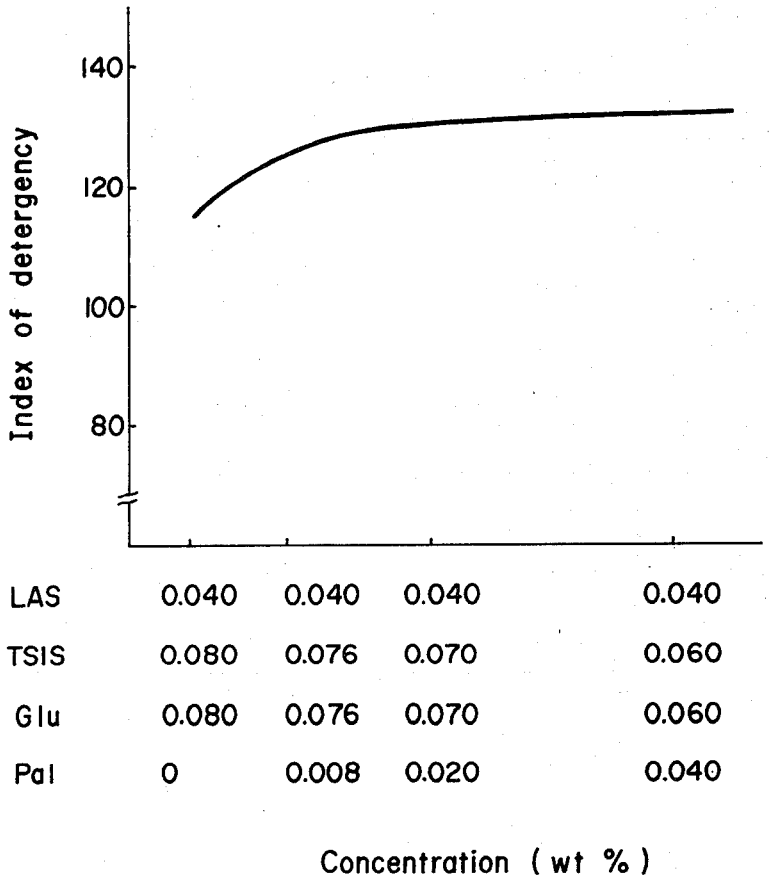
FIGS. 4 and 5 show the relationship between the ratio of components and the index of detergency with respect to the present detergent compositions consisting of a sodium linear-alkylbenzene sulfonate, trisodium imido-bis-sulfate, sodium palmitate, and sodium N,N-bis(carboxymethyl)glutamate (FIG. 4) and sodium N,N-bis(carboxymethyl)phenylalanine (FIG. 5), respectively.
Figure 5:
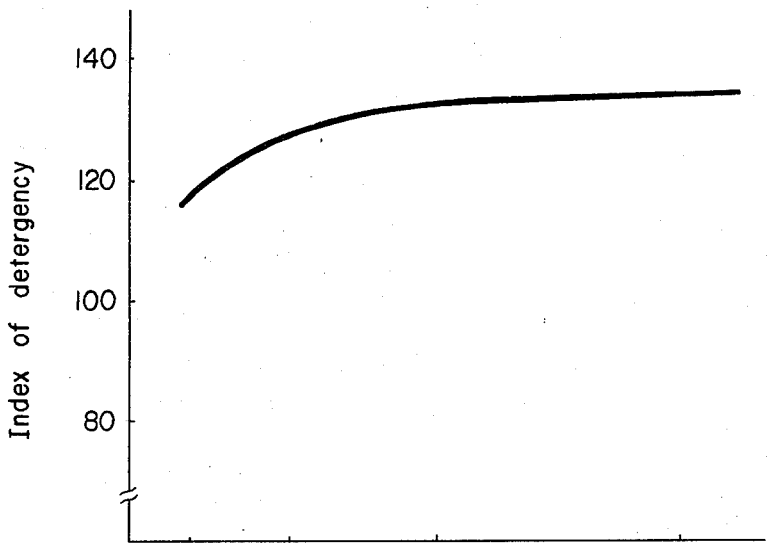

As clearly shown in FIGS. 4 and 5, the detergent compositions containing TSIS, Pal, and Glu or Phal further enhance the washing performances in comparision with the compositions obtained in Reference Examples. Especially, it should be noted that the index of detergency over 120 shows a marked synergistic effect in the course of the washing operation.

As shown in the above-mentioned example, when the detergency index of the standard detergent composition containing 20% of sodium tripolyphosphate is set to 100, the detergency indexes of the present detergent compositions are recognized to be much higher than 100.

In the actual use of a detergent, such a high index of detergency means that the dirts and stains on clothes are clearly realized to come out cleanly, and it also shows a marked washing performance. Incidentally, it is a fact that some detergent compositions on the market have the indexes of detergency as low as 80 to 90.

What is claimed is:

1. A detergent composition comprising:

100 parts by weight of a synthetic surface active agent selected from the group consisting of anionic surface active agents, nonionic surface active agents and mixtures thereof; and an effective amount of a mixture consisting essentially of 30 to 700 parts by weight of an imido-bis-sulfate of the formula $(M^1SO_3)_2NM^2$ wherein $M^1$ represents lithium, sodium, potassium or ammonium, and $M^2$ represents hydrogen, lithium, sodium, potassium or ammonium;

3 to 60 parts by weight of sodium palmitate or potassium palmitate; and 1 to 250 parts by weight of at least one compound selected from the group consisting of tetrasodium or tetrapotassium N,N-bis(carboxymethyl)glutamate, and trisodium or tripotassium of N,N-bis(carboxymethyl)phenylalanine.

2. A detergent composition according to claim 1, wherein the weight ratio of said mixture consisting essentially of said imido-bis-sulfate, said palmitate and said N,N-bis(carboxymethyl)glutamate or N,N-bis(carboxymethyl)phenylalanine salt to said synthetic surface active agent is 40/100 to 1000/100.

3. A detergent composition according to claim 1, wherein said imido-bis-sulfate is trisodium imido-bis-sulfate.

* * * * *